United States Patent [19]

Schulz et al.

[11] 4,106,280

[45] Aug. 15, 1978

[54] METHOD AND APPARATUS FOR SYNCHRONIZING A MECHANICAL OSCILLATING SYSTEM TO THE ACCURACY OF A QUARTZ STANDARD

[76] Inventors: Hansrichard Schulz, Obere Waldstr. 2a, D-7730 VS-Villingen; Herbert Hummel, Am Hummelberg 16, D-7732 Niedereschach, both of Fed. Rep. of Germany

[21] Appl. No.: 670,003

[22] Filed: Mar. 24, 1976

[30] Foreign Application Priority Data

| | | | |
|---|---|---|---|
| Mar. 27, 1975 | [DE] | Fed. Rep. of Germany | 2513583 |
| Sep. 6, 1975 | [DE] | Fed. Rep. of Germany | 2539774 |
| Jan. 22, 1976 | [DE] | Fed. Rep. of Germany | 2602226 |

[51] Int. Cl.[2] ..... G04C 3/02; G04C 3/04; G04C 5/00

[52] U.S. Cl. ..... 58/28 R; 58/23 A; 58/23 D; 58/29; 58/107; 324/82

[58] Field of Search ..... 58/23 R, 23 A, 28 R, 58/28 A, 28 B, 28 D, 29–32, 107–110; 318/126–130; 331/116 M; 73/6; 324/80, 82, 83 FE, 83 FM

[56] References Cited

U.S. PATENT DOCUMENTS

| | | | |
|---|---|---|---|
| 3,451,210 | 6/1969 | Helterline, Jr. et al. | 58/28 R UX |
| 3,844,106 | 10/1974 | Scherrer | 58/23 R X |
| 3,892,066 | 7/1975 | Watkins | 58/28 R |
| 3,905,188 | 9/1975 | Nishikubo et al. | 58/23 R |
| 3,921,386 | 11/1975 | Keller | 58/28 R |
| 3,952,497 | 4/1976 | Schulz et al. | 58/28 R |
| 3,965,667 | 6/1976 | Scherrer et al. | 58/28 A |
| 4,007,582 | 2/1977 | Dugan et al. | 58/23 R |

*Primary Examiner*—Stanley J. Witkowski
*Attorney, Agent, or Firm*—Haseltine, Lake, & Waters

[57] ABSTRACT

An arrangement for synchronizing a mechanical oscillating system to the accuracy of a quartz standard, in particular the timing of a clock. Timing pulses are derived from a quartz oscillation, and these act on the frequency of the oscillating system. An "existing value" signal is derived from the oscillating system, and frequency deviations of the existing value signal from the timing pulses are detected by a phase comparison. The frequency of the mechanical oscillating system is processed in accordance with the deviations that are detected.

32 Claims, 20 Drawing Figures

Figure 1:
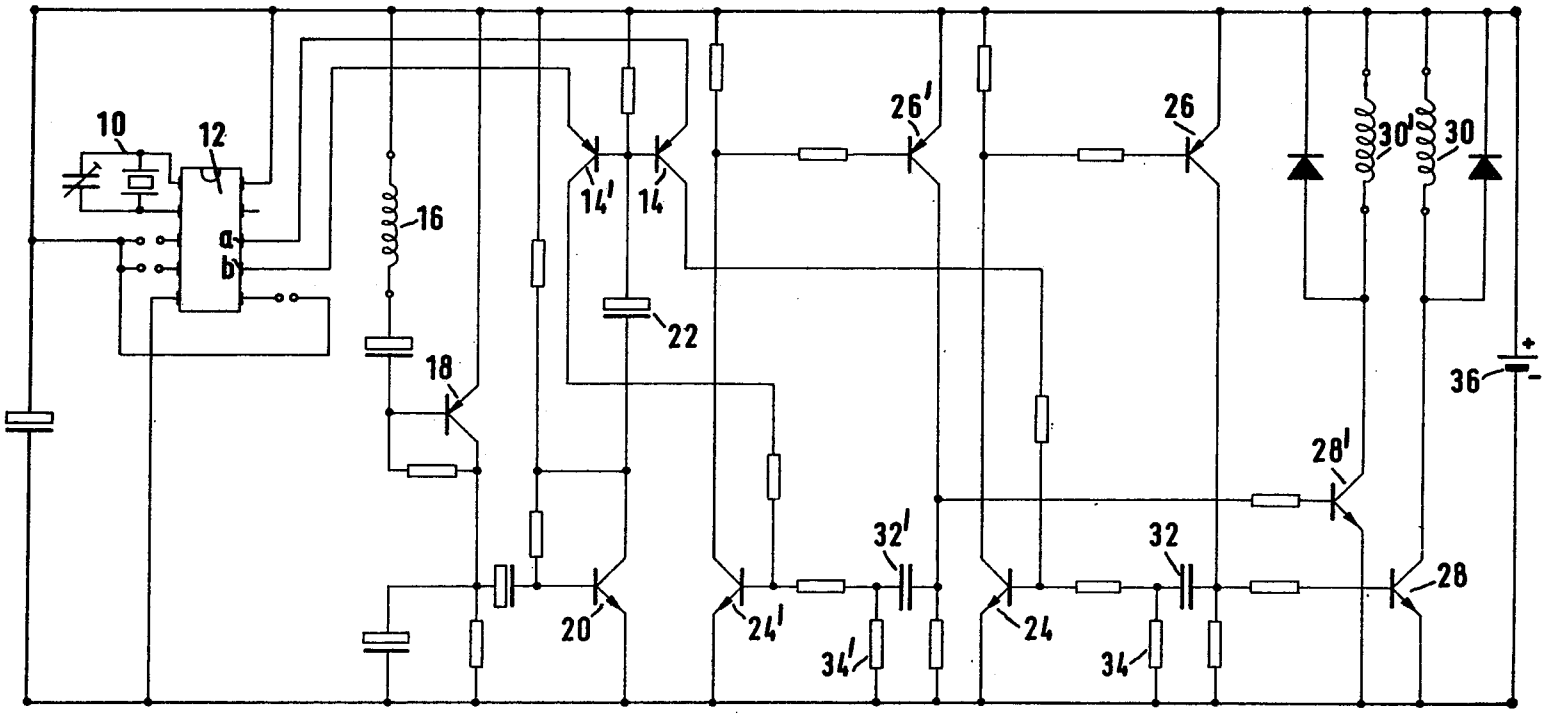

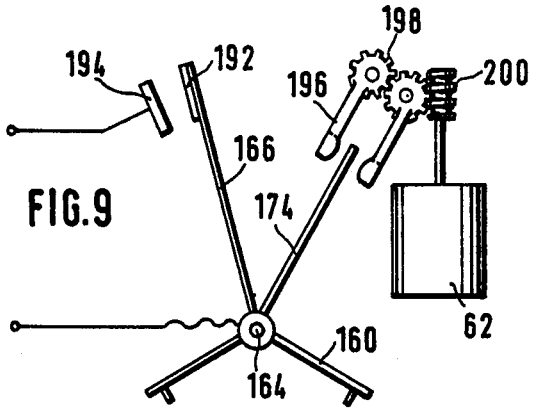
FIG.9
FIG.10
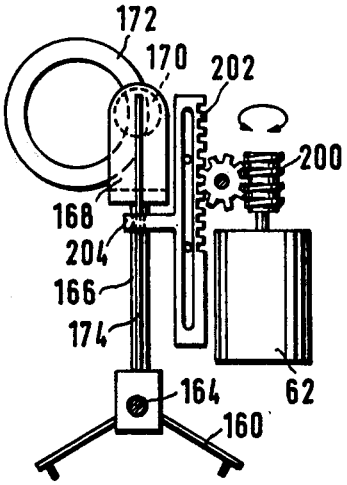
FIG.11
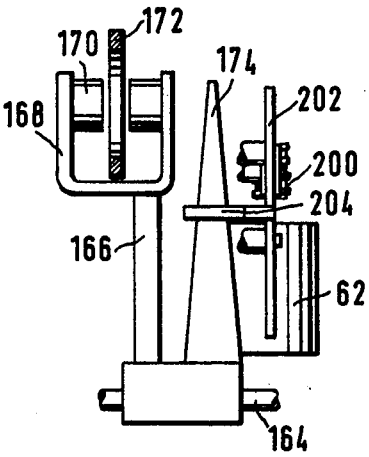

FIG.12
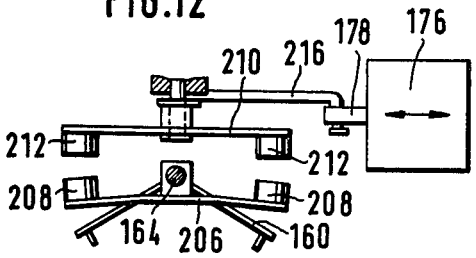
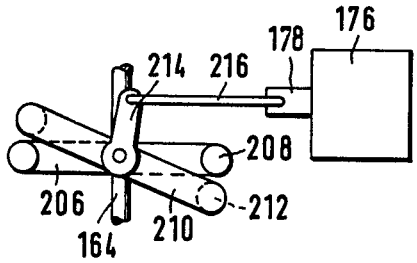
FIG.13
FIG.14
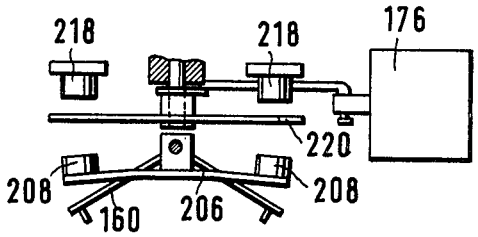
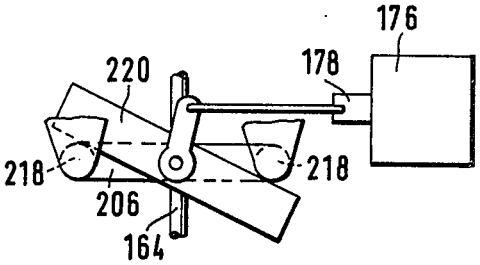
FIG.15

FIG.17
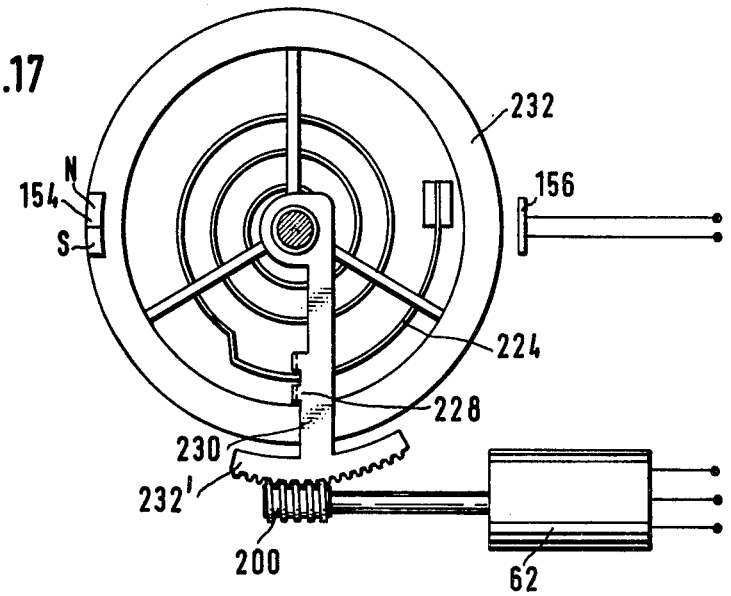
FIG.18
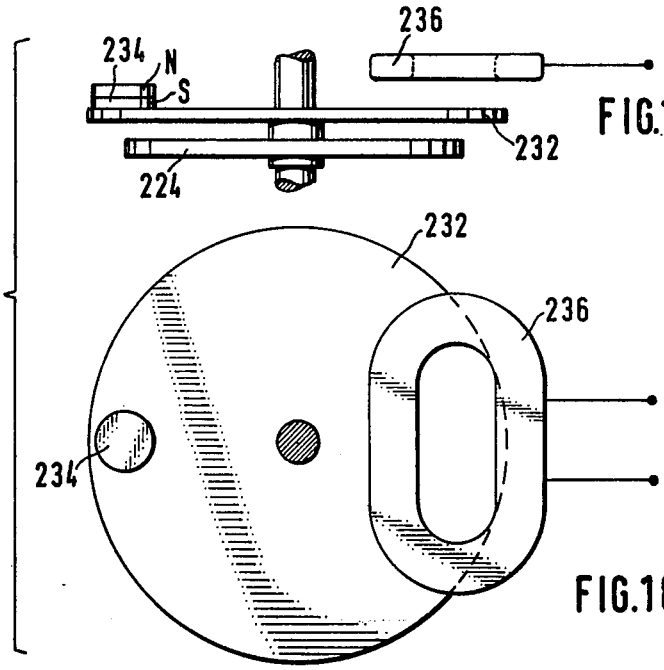
FIG.18A
FIG.18B

METHOD AND APPARATUS FOR SYNCHRONIZING A MECHANICAL OSCILLATING SYSTEM TO THE ACCURACY OF A QUARTZ STANDARD

The invention relates to a method for the synchronization, to the accuracy of a quartz standard, of a mechanical oscillating system, in particular the timing control of a clock, in which timing pulses derived from a quartz oscillation act on the frequency of the oscillating system. Further, the invention concerns an apparatus for carrying out this method.

Mechanical oscillating systems, such as the balance wheel or pendulum of a mechanical clock mechanism, are subject to considerable irregularities in operation, particularly by reason of temperature fluctuations and other external influences. In order to reduce such irregularities in operation due to external influences, it is necessary to employ extremely elaborate devices for the mechanical oscillating system.

It is known, with a view to obtaining greater working accuracy with reduced expense, to synchronize mechanical clocks by means of quartz timing pulses. In the case of this known form of synchronization the drive moment, which is controlled by quartz timing pulses, acts on this oscillating system in addition to the driving pulse of the mechanical oscillating system. The mechanical clock mechanism can be caused to work with a quartz-based accuracy through such direct synchronization, but the synchronization range is very small. Very high reliance therefore has to be placed on the working accuracy of the mechanical oscillating system, so that it is impossible to achieve any substantial cheapening of the mechanical clock mechanism.

The object of the present invention is to provide a method for synchronization, to the accuracy of a quartz standard, of mechanical oscillating systems, in particular of mechanical clocks, this method having a very wide synchronization range, so that it can also be used for synchronization to the accuracy of a quartz standard, of cheap mechanical oscillating systems subject to large working irregularities.

It is a further object of the invention to provide an apparatus for carrying out this method, this apparatus in particular enabling an existing mechanical clock mechanism to be subsequently provided with synchronization of a quartz-based accuracy.

According to the invention this object is realized by arranging for an "existing value" signal to be derived from the oscillating system; for frequency deviations of the existing value signal from the timing pulses to be detected by a phase comparison; and for the frequency of the oscillating system to be acted on in accordance with the deviations detected.

The basic principle of the invention consists in the fact that, in contradistinction to the known synchronization methods, an indirect synchronization is carried out. According to the invention, the quartz timing pulses do not directly act on the oscillating system, but a comparison is carried out between the prescribed frequency of the quartz timing pulses and the actually-existing frequency of the oscillating system, and the frequency of the oscillating system is only acted on (for synchronizing purposes) if, through a phase comparison between the actually-existing signals and the prescribed signals, a frequency disparity is detected. Thus, the method according to the invention is a genuine control process which makes a wide synchronization range available. Very small demands are therefore made on the working accuracy of the mechanical oscillating system. The method according to the invention can, in particular, be used for synchronizing pendulum clocks and tower clocks, which react particularly sensitively when their intrinsic oscillation is acted on forcibly. Direct synchronization cannot be employed where these clocks are concerned, because it would so strongly affect the pendulum amplitude that the clock would either stop or rebound.

According to one embodiment of the method according to the invention, the frequency of the oscillating system is abruptly switched between an extreme value lying above the prescribed frequency and an extreme value lying below the prescribed frequency, the dwell time of the oscillating system in each of these extreme values being determined by, in each case, a separate phase comparison between the actually-existing signal and the timing pulses. This indirect synchronization method provides a two-step control which, in addition to the above-mentioned advantage of a wide synchronization range, affords the further advantage that the oscillating frequency of the mechanical system can be acted on in a particularly simple manner. This is because it is only necessary to switch between two fixed frequency values. This process whereby the oscillating frequency is acted on can be carried out mechanically in a simple way, so that this method is particularly suitable for equipping an already-existing clock mechanism.

In a second embodiment of the method according to the invention, the frequency is acted on continuously and proportionally to the deviation from the prescribed frequency or prescribed phase. This indirect synchronization method provided a proportional positional control of the oscillating frequency.

One particular advantage of this embodiment of the method according to the invention consists — above all and in addition to the very wide synchronization range — in the fact that the actual frequency of the oscillating system coincides, with maximum accuracy, to the prescribed frequency. The frequency only has to be acted on minimally, for control purposes, and this only occurs when the existing frequency value differs from the prescribed frequency by reason of some fluctuations of the external influences away from the prescribed frequency. On the other hand, in the case of two-step control, the frequency of the oscillating system is continuously acted on.

It is recommended to use — according to the invention and for effecting indirect synchronization in a two-step form of control — an apparatus with two phase comparison stages, which, firstly, lies downstream of a quartz oscillator, with a frequency divider connected to it and, secondly, is connected to a mechanical-electrical transducer, arranged on the oscillating system, the outputs of which stages are connected to the two triggering inputs of a bistable electromechanical transducer which acts on the frequency of the oscillating system. The bistable electromechanical transducer will preferably be a control magnet, by means of which a member, which acts on the frequency of the oscillating system, is switched over between two positions, the oscillating frequency in one of these positions lying below the prescribed frequency and, in the other position, above the prescribed frequency.

It is found that — for carrying out the indirect synchronization method, using a proportional position control method — it is particularly appropriate to employ, according to the invention, an apparatus having a quartz timing generator, and a phase comparison stage, to whose input there is fed, firstly and by way of a frequency divider, the timing pulses of the generator and, secondly the "existing-value" signals taken from the mechanical oscillating system, the output of this stage being connected to a member which acts on the frequency of the oscillating system and is continuously positionable by the output signal of the phase comparison stage.

In one embodiment this member, which acts on the frequency of the oscillating system, is a mechanical member which is actuated by a control motor, itself controlled by the output signal of the phase comparison stage. This embodiment affords the advantage that the mechanical member, which acts on the frequency, remains in the position it has been caused to assume in respect of the prescribed frequency, even if the synchronization apparatus drops out. Therefore the synchronization, carried out to a quartz-based accuracy, remains effective at least for a certain period of time.

In another embodiment the member, acting on the frequency, consists of one or more accelerating coils, which act electromagnetically on the oscillating system so as to accelerate or decelerate the latter, and whose coil current or magnetic field is controlled by the output signal of the phase comparison stage. This embodiment has the particular advantage that the frequency can be acted on in a contact-free manner, and this is particularly suitable for equipping existing clock mechanisms with the synchronization apparatus.

In a further embodiment of the invention it is additionally possible to synchronize the frequency of the quartz oscillations by a comparison with the signals of a time signal- and normal frequency-transmitter, controlled by an atomic clock.

In this way the clock mechanism can be made to run with an accuracy corresponding to the stability of the quartz oscillation; furthermore there is achieved an absolute running accuracy which coincides with normal time. For this purpose the quartz oscillator must be additionally equipped with a receiver for the normal frequency time signal and with a synchronization device.

Figure 2:
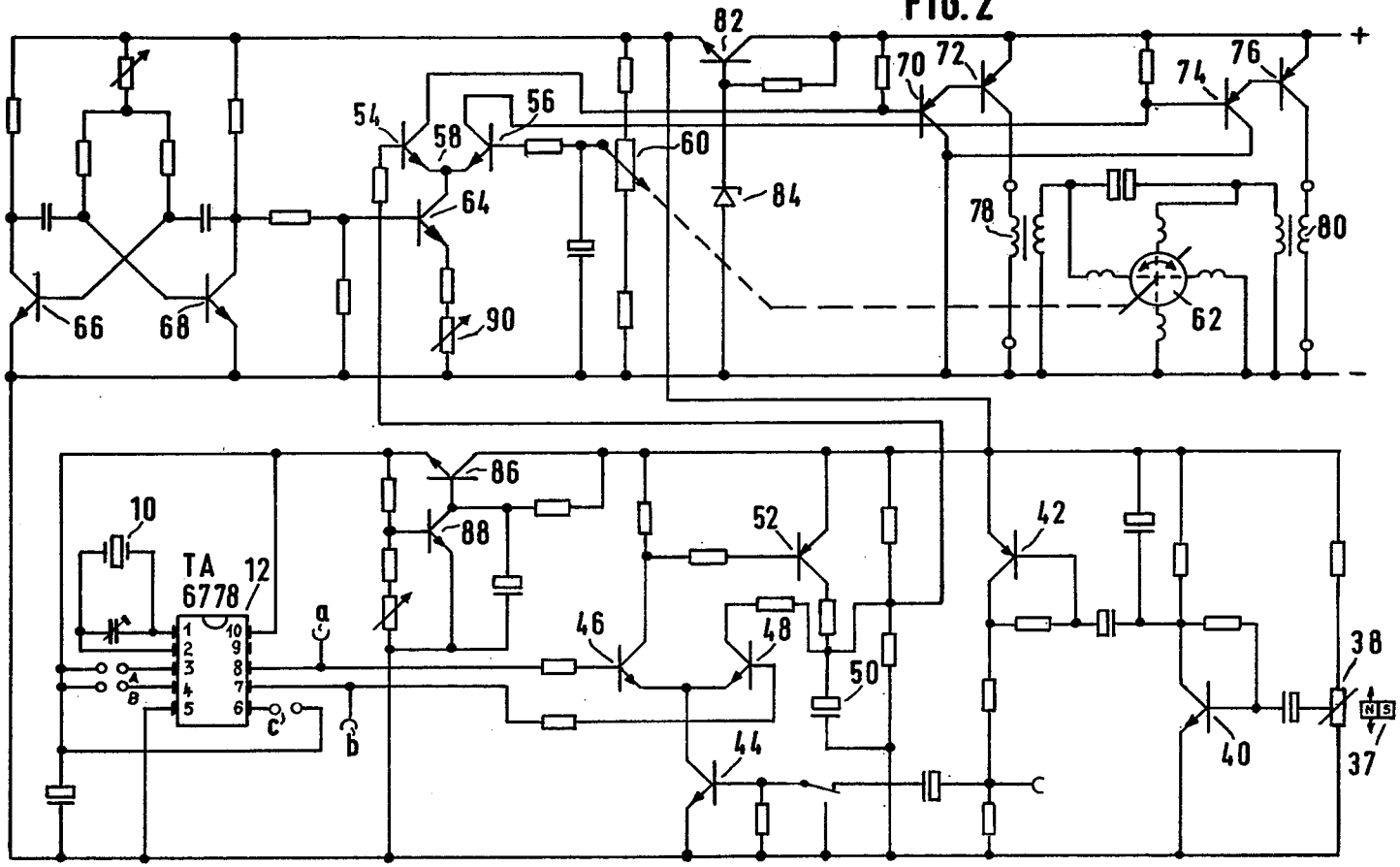
Figure 3:
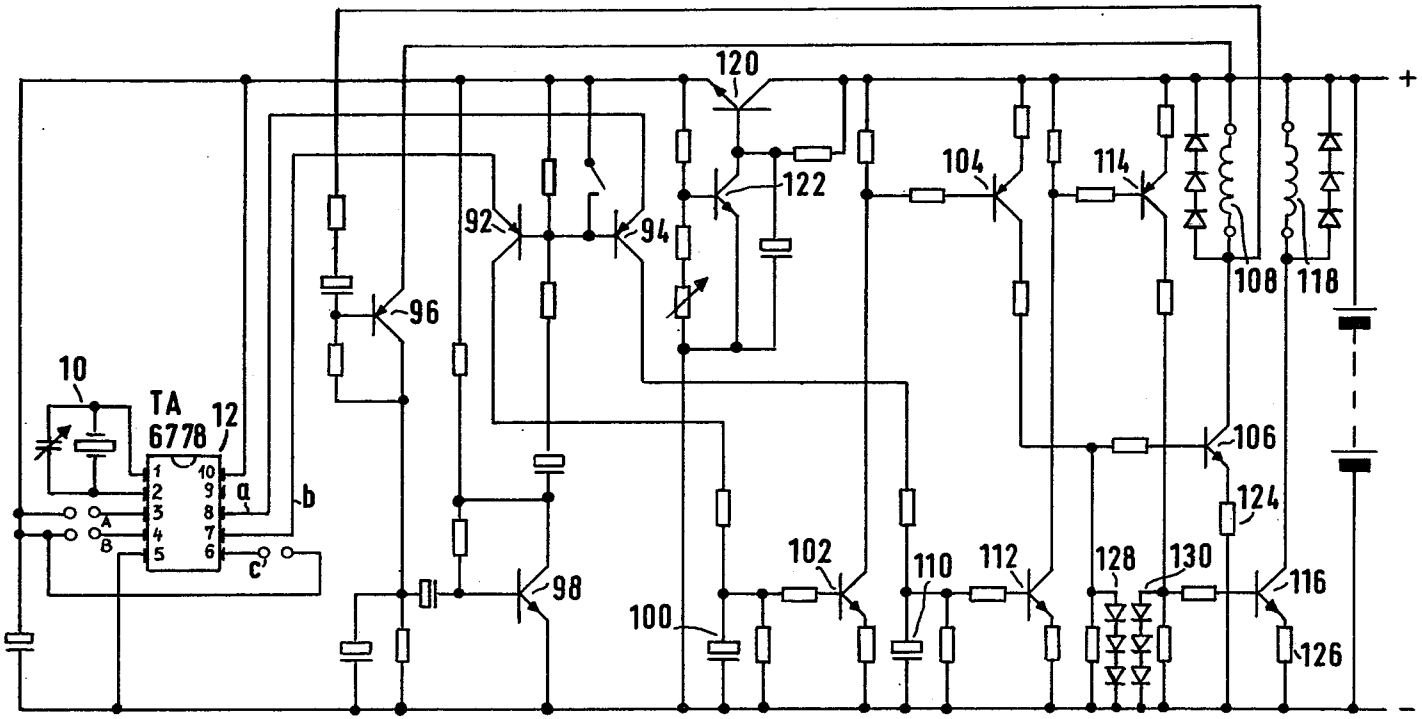
Figure 4:
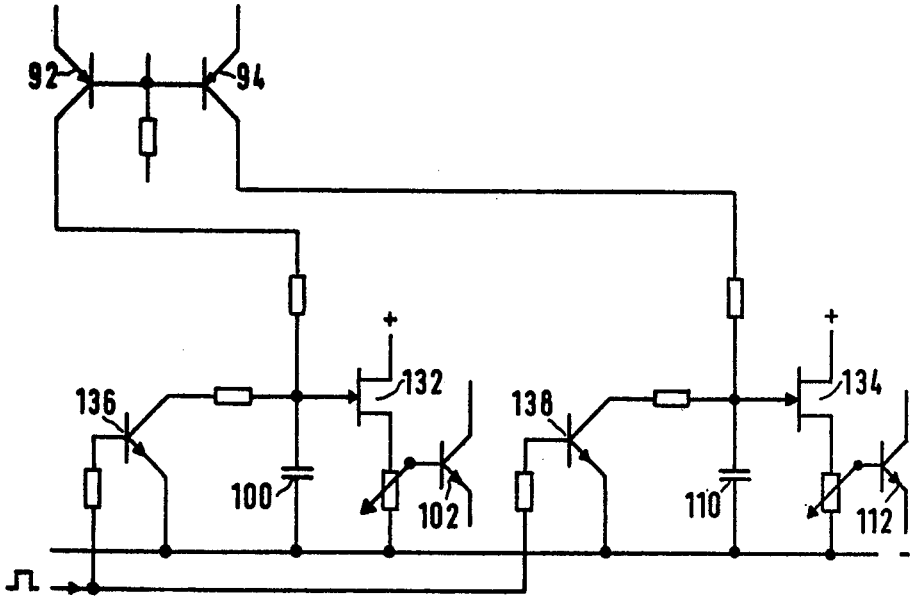
Figure 5:
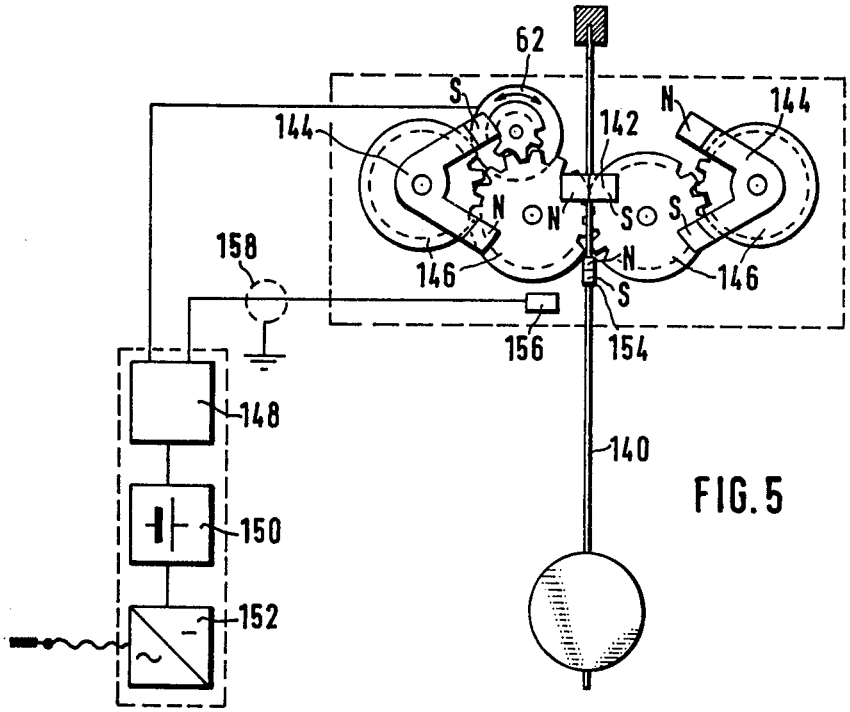
Figure 6:
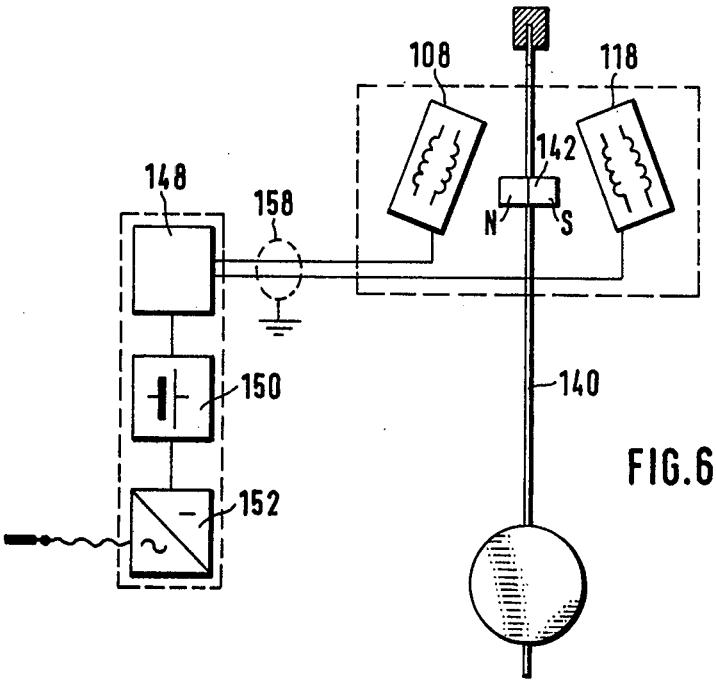
Figure 7:
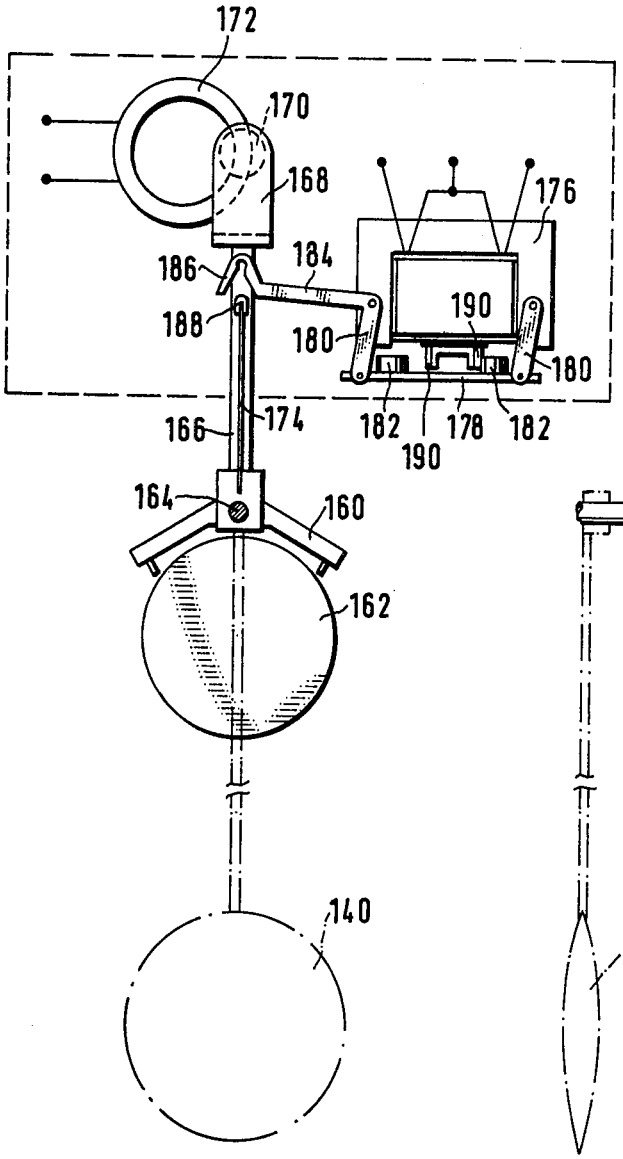
Figure 8:
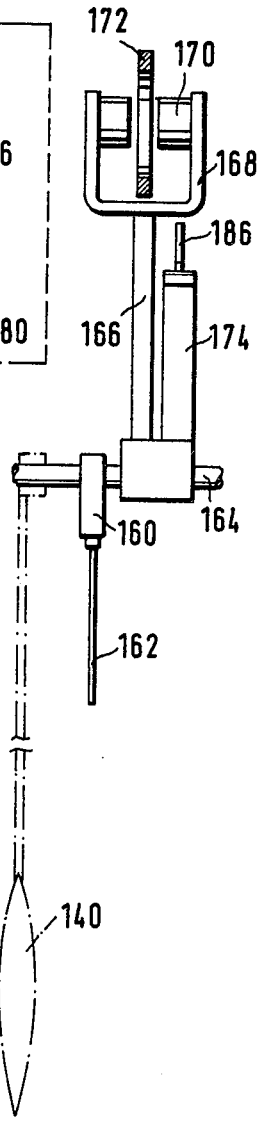
Figure 16:
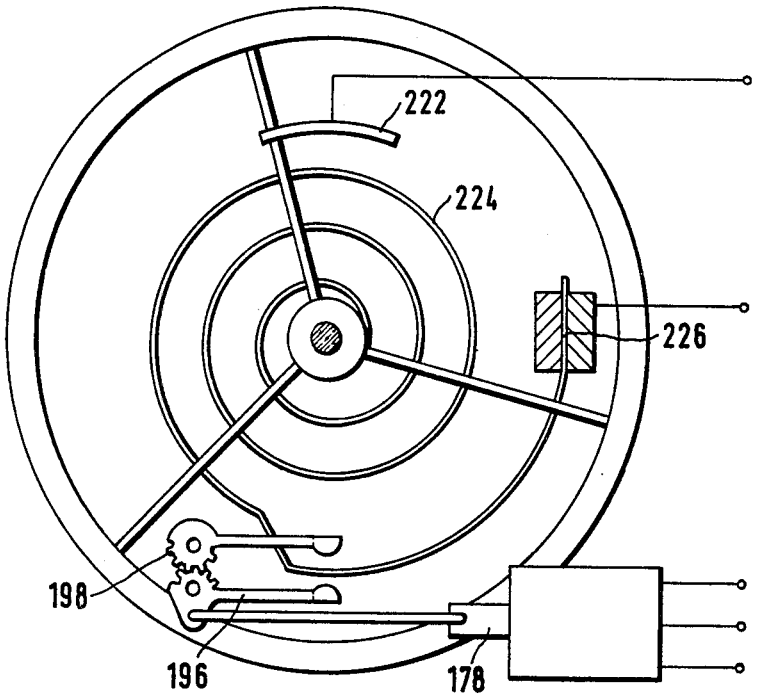

Further features and advantages of the invention will be clear from the following description of embodiments of the invention, described with reference to the appended drawings, in which:

FIG. 1 illustrates the circuit layout for carrying out the method according to the invention, with "two-step" control, FIG. 2 is a circuit layout for carrying out the method according to the invention, with proportional position control and using a control motor, FIG. 3 is a circuit layout for carrying out the method according to the invention, with proportional position control and using acceleration coils, FIG. 4 illustrates a modification of the circuit layout shown in FIG. 3, FIG. 5 illustrates an embodiment of the invention, in which proportional position control is exercised over the oscillation frequency of a clock pendulum with the assistance of a control motor, FIG. 6 illustrates an embodiment of the invention, with proportional position control of the oscillation frequency of a clock pendulum, with the use of acceleration coils, FIG. 7 illustrates an embodiment of the invention with two-step control of the frequency of oscillation of a clock pendulum, using a control magnet, FIG. 8 is a side view of the subject matter shown in FIG. 7, FIG. 9 illustrates a modification of the embodiment shown in FIG. 7, FIG. 10 illustrates an embodiment of the invention, with proportional position control of the frequency of oscillating of a clock pendulum, with the assistance of a control motor, FIG. 11 is a side view of the subject matter illustrated in FIG. 10, FIG. 12 illustrates another embodiment of the invention with two-step control of the frequency of oscillating movement of the clock pendulum, with the assistance of a control magnet, FIG. 13 is a plan view of the subject matter of FIG. 12, FIG. 14 illustrates a further embodiment of the invention, with two-step control of the frequency of oscillating motion of a clock pendulum, with the assistance of a control magnet, FIG. 15 is a plan view of the embodiment shown in FIG. 14, FIG. 16 illustrates an embodiment of the invention with two-step control of the oscillation frequency of a balance wheel, with the assistance of a control magnet, FIG. 17 illustrates an embodiment of the invention with proportional position control of the oscillation frequency of a balance wheel, with the assistance of a control magnet, and FIG. 18A illustrates a side view of an embodiment of the invention proportional position control of the oscillation frequency of a balance wheel, with the assistance of an acceleration coil, FIG. 18B is a plan view of the embodiment of FIG. 18A.

The embodiment illustrated in FIG. 1, in which indirect synchronization is exercised with two-step control, is illustrated below; there is selected, as numerical example, the synchronization of a pendulum clock with a "1 second" pendulum (oscillation frequency of 0.5 Hz).

To distinguish between polarized electrolytic capacitors and unpolarized capacitors, different symbols are used for these two elements. Thus, electrolytic polarized capacitors are denoted by the symbol such as shown by the element 22 in FIG. 1, whereas unpolarized capacitors have the symbol as shown by the element 32 in FIG. 1.

The pulses of a quartz oscillator 10 are subdivided to a timing frequency of 0.5 Hz. Alternate pulse sequences of this timing frequency are taken from the outputs *a* and *b* of the frequency divider 12. This means that a positive timing pulse occurs, for example at output *a*, in the first, third, fifth . . . seconds only and, at output *b*, in the second, fourth, sixth . . . seconds only.

The timing pulses from the outputs *a* and *b* are fed to the emitters of transistors 14 and 14' respectively; as will be described below, these transistors act as phase comparison stages.

An "actually existing value" signal, corresponding to the instantaneous frequency of the rocking or oscillating system, is induced in an induction coil 16 by a permanent magnet which is fixed to the oscillating system, for example to the pendulum, and rocks with this pendulum. This actually-existing value signal is amplified by way of the capacitatively coupled transistors 18 and 20 and is passed, by way of capacitor 22 and as a negative pulse, to the base of transistors 14 and 14'.

Transistors 14 and 14' function as AND-gates for effecting a phase comparison between the quartz timing pulses and the actually-existing value signal. Thus, transistors 14 and 14' only generate a collector pulse when the positive quartz timing pulse is present at the emitter and the negative pulse of the actually-existing signal is at the same time present at the base.

When such coincidence occurs at transistor 14, for example of the quartz timing pulse from output *a* of the frequency divider together with the actually-existing value pulse, this transistor is rendered conductive. The collector current pulse of transistor 14 is passed to base of transistor 24, and renders the latter conductive. Consequently, transistor 26 and, finally, transistor 28 conduct current.

If transistor 28 is in this way rendered conductive, on the occasion of a coincidence of a quartz timing pulse and of an actually-existing value signal at transistor 14, then a current will flow through one of the coils 30 of a bistable control magnet, which acts on a member, which itself acts on the frequency of the mechanical oscillating system and will be described below. In order to ensure that there is sufficient excitation of coil 30 and, accordingly, a reliable response of the control magnet — even when the collector current pulse at transistor 14 is only a short one — a feedback loop is interposed in the control signal path formed by transistor 24, 26 and 28. For this purpose the collector of transistor 26 is connected, by way of a feedback capacitor 32, to the base of transistor 24. A resistor 34 is positioned between the connection point, lying closer to the transistor 24, between the capacitor 32 and the electrical supply line leading to the negative terminal of voltage source 36. In this way transistors 24 and 26 form a mono-stable multivibrator whose triggering time point is determined by the time constant, itself determined by the values of the capacitor 32 and of the resistor 34. Through suitably dimensioning the capacitor 32 and the resistor 34, the period during which the multivibractor is triggered can be selected such that a reliable response of the control magnet is ensured. For example, a time constant of 40 ms may be selected.

When there is coincidence between the timing pulse from output *b* of the frequency divider 12 and the actually-existing value signal at transistor 14', the other coil 30' of the control magnet will be energized in the above-described manner and by way of transistors 24', 26' and 28'. Feedback by way of capacitor 32' causes this control signal path to function as a monostable vibrator, whose time constant is determined by the dimensioning of the capacitor 32' of the resistance 34'. The construction and dimensioning of this second control signal path are identical to those described for the first control signal path. The way in which the above-described circuit layout functions is described below:

The required starting point is that at which the actually-existing value signal, taken from the pendulum of the clock neither coincides, in time, with the quartz timing pulse from the output *a* of the frequency divider 12 at transistor 14, nor with the quartz timing pulse from output *b* of frequency divider 12 at transistor 14'. Therefore neither of the AND-gates, constituted by the transistors 14 and 14' delivers an output signal, and the two coils 30 and 30' of the bistable control magnet are without current. The member which acts on the frequency of the mechanical oscillating system is therefore in a position corresponding to an extreme frequency value. This may, for example, be the position corresponding to when the clock is running "too fast", that is to say to a frequency which lies above the prescribed frequency.

As the frequency of the oscillating system in this case is higher than the frequency of the quartz timing pulses, the actually-existing value signal taken from the mechanical oscillating system is shifted in time relative to the quartz timing pulses and approaches, in time, the timing pulses arriving from the output *a* of the frequency divider 12. If the actually-existing value signal is so misphased, in time, that it coincides, in time, with the timing pulse from output *a*, then a collector pulse is generated in transistor 14 and results, in the way described above, in energization of coil 30 of the control magnet. By virture of the feedback in the control signal path (chain), and of the operation (thereby arrived at) as a monostable multivibrator, it will be ensured that, at the time of the first of such coincidence pulses, coil 30 will be sufficiently well energized.

The consequence of energization of coil 30 is that the control magnet switches over the member, which acts on the frequency of the mechanical oscillating system, into its second condition, this second condition corresponding to the other extreme value of the oscillating frequency, this extreme value lying below the prescribed frequency and thus corresponding to the clock going "too slow".

The bistable control magnet and, hence, the frequency of the member which affects the mechanical oscillating system now persist in this condition of "too slow" oscillation of the mechanical oscillating system. In this way the actually-existing value signal, taken from the mechanical oscillating system, is shifted in the opposite direction relative to the quartz timing pulses, until this signal coincides, in respect of time, with the quartz timing pulse from output *b* of frequency divider 12. Owing to this coincide transistor 14' is rendered conductive and generates a collector current pulse which, in the above-described way, energizes the control magnet coil 30'. In this way the member which acts on the frequency is switched over into the first condition, which results in the too high exterme value of frequency of the mechanical oscillating system. Thus, the above-described cycle of two-step control recommences. The above-described mode of operation makes it clear that the phase position of the mechanical oscillating system deviates, at any desired point of time, by less than $\pm\pi/2$ from the quartz timing standard. Thus, in the above-described example the deviation is smaller, at any time point, than $\pm 0.5$ seconds, and the mechanical clock (for example a pendulum clock) will operate, over any desired time periods, to within $\pm 0.5$ sec. of the quartz accuracy.

FIG. 2 illustrates a second circuit layout for indirect synchronization, with proportional position control.

As in the case of the circuit shown in FIG. 1, the high-frequency timing generator 10 generates — at outputs *a* and *b* and in conjunction with the frequency divider 12, constituted as an integrated circuit — positive timing pulses, which alternate in time and are of, for example, 31.6 ms duration and of a timing frequency of for example 0.5 Hz. The two alternating quartz timing pulse sequences are fed to the inputs of two transistors 46 and 48, which are so arranged in the circuit that they act as a phase comparison stage.

The actually-existing value signal, required for a phase comparison with the quartz timing pulses, is taken, in a manner to be described below, from the mechanical oscillating system in a way such that a permanent magnet 37 — which is mechanically coupled to an oscillating system, for example to the pendulum of a clock — sweeps over a field plate 38 in the course of its oscillating motion, and induces an electrical signal in this plate 38.

This actually-existing value signal is amplified by way of transistors 40 and 42 and passed to a transistor 44 which serves as a common variable resistance for transistors 46 and 48 in the differential amplifier circuit and forms a series-AND gate either with transistor 46 or transistor 48.

The output connections of transistors 46 and 48 are connected to a storage capacitor 50, the output signal of transistor 46 being reversed in a transistor 52. The output signals of transistors 46 and 48 therefore affect the storage capacitor 50 in opposite directions, so that the d.c. voltage of capacitor 50 — this d.c. voltage corresponding in the rest condition to (for example) half the stabilized voltage, for example 5 V — is increased by an output signal of transistor 46 and decreased by an output signal of transistor 48.

The voltage of storage capacitor 50 is passed to one of the transistors 54 of a second differential amplifier 58. A comparison voltage is applied to the second transistor 56 of this second differential amplifier 58, this comparison voltage being trapped from a feedback potentiometer 60, which is coupled to a control motor 62 which, in a manner to be described below, acts on the frequency of the member, which itself affects the frequency of the mechanical oscillating system. Thus, the voltage tapped from feedback potentiometer 60 reproduces the position of this member, which acts on the frequency.

A transistor 64, interposed into the common emitter connection of the transistors 56 and 54, acts as a "pulsed current source" of the differential amplifier 58. By means of a multivibrator and transistors 66 and 68, this transistor 64 is controlled in the rhythm of the frequency (for example 60 Hz) suitable for the synchronous motor 62.

The outputs of transistors 54 and 56 are connected, through the intermediary of transistors 70 and 74 respectively, to power transistors 72 and 76. Transformers 78 and 80 are fed the power transistors 72 and 76 respectively and drive the control motor 62 in opposite directions of rotation.

The voltage supply of the circuit is served by a transistor 82 which, in conjunction with a Zener diode 84, produces a stabilized d.c. voltage of for example 5 V. Through the provision of this voltage stabilization it is at the same time ensured that there will be no feedback from the power transistors 72 and 76 to the phase comparison stage.

By means of the further transistors 86 and 88 a highly stable d.c. voltage of, for example, 1.5 V is produced from this stabilised d.c. voltage of for example 5V; the quartz timing pulse generator 10 and the frequency divider 12 are supplied with this stable d.c. voltage. Accordingly, the quartz timing pulses are of maximum frequency stability.

The circuit layout illustrated in FIG. 2 functions in the following way:

In the prescribed condition, that is to say when the frequency of the mechanical oscillating system is correct, the two transistors 46 and 48 of the phase comparison stage are initally blocked, as the actually existing value signal, arriving at transistor 44, lies, in time, between the quartz timing pulses concurrently arriving at transistors 46 and 48. In this condition the storage capacitor will therefore have a rest (inoperative) voltage of, for, example 2.5 V.

The voltage tapped from the feedback potentiometer 60 also amounts to 2.5 V so that, if the variable emitter resistor 90 of the second differential amplifier 58 is suitably adjusted, power transistors 72 and 76 will not draw any current.

If, in consequence of external influences, the frequency of the mechanical oscillating system now alters, then the existing value signal, arriving at transistor 44, will become misphased relative to the quartz timing pulses arriving at transistors 46 and 48 depending on whether there is an increase or reduction of the existing frequency, and on the direction - linked with this increase or decrease in the actually existing frequency — of the phase shift of the existing-value signal relative to the quartz timing pulses, there will be a coincidence, with respect to time, of the existing-value signal with one of the two quartz timing pulses at transistors 46 and 48.

If this coincidence occurs, for example, with the quartz timing pulse arriving at transistor 46, then the storage capacitor 50 is charged, by way of the reversing transistor 52, to a higher voltage, for example 2.7 V. The result of this is that transistor 54 of the second differential amplifier 58 draws, subject to the control of transistor 64, a greater collector current. In this way the power transistor 72 is periodically rendered conductive in the rhythm of the frequency of the multivibrator 66, 68. Control motor 62 is rotated, through the intermediary of transformer 78, sufficiently far to cause this phase deviation to be corrected, and the feedback potentiometer 60 supplies a correspondingly greater voltage of for example 2.7 V, so that the control motor 62 is switched off again.

In a similar way a coincidence of the existing-value signal at transistor 44 with the quartz timing pulse at transistor 48 leads to a lowering of the voltage of the storage capacitor 50. The consequence of this is that transistor 56 of the second differential amplifier 58 draws current, the power transistor 76 is rendered conductive in the rhythm of the multivibrator, and the control motor 62 is turned, by transformer 80, in the opposite direction. If, in this way, the feedback potentiometer 60 has reached the lower voltage of the storage capacitor 50, the control motor 62 is switched off.

FIG. 3 illustrates another embodiment of circuit layout for the phase comparison stage and for the indirect synchronization by proportional position control.

As in the case of the circuit layout shown in FIG. 2, two pulse sequences, which alternate in time and are of positive polarity, are taken, by the quartz timing generator 10 the frequency divider 12 connected to the latter, from the outputs *a* and *b*. These pulse sequences are fed to the phase comparison stage, which consists of two transistors 92 and 94 which act as AND-gates.

The quartz timing pulses are fed to the emitters of transistors 92 and 94, while the existing-value signal is fed to the bases of these transistors. This existing-value signal may, for example, be taken from an induction coil which, as in the case of the circuit layout represented in FIG. 3, may be constituted as one of the acceleration coils which will be described below. The existing-value signal, generated in the induction coil by the mechanical oscillating system, is amplified by way of transistors 96 and 98 before reaching the bases of the AND-gates 92 and 94.

In the prescribed condition, if the existing-value signal lies, with respect to time, between the quartz timing pulses, the two transistors 92 and 94 are blocked. However, if the frequency of the mechanical oscillating system deviates from the prescribed frequency, this leads to a phase shift of the existing-value signal relative to the quartz timing pulses, until the existing-value signal coincides, in time, with the quartz timing pulse in one of transistors 92, 94.

If the frequency of the mechanical oscillating system is too great, that is to say if the clock mechanism is running too fast, this coincidence will, for example, occur in the AND-gate transistor 92. Due to this coincidence transistor 92 is opened, and a storage capacitor 100 is charged, in pulsed manner, to a positive voltage. The positive voltage of the storage capacitor 100 opens a transistor 102 of an amplification channel which, again, opens downstream-connected transistors 104 and 106 of this amplification channel. The collector current of the power transistor 106 flows through an acceleration coil 108, and generates a magnetic field in this coil. This magnetic field affects the mechanical oscillating system, for example by way of a permanent magnet coupled to the oscillating system, in a manner to be described below, so that the oscillation of this mechanical oscillating system is slowed down.

In the circuit arrangement illustrated in FIG. 3, the acceleration coil 108 simultaneously represents the induction coil from which the existing-value signal is taken.

If the frequency of the mechanical oscillating system deviates, from the prescribed frequency, in the direction of low values — that is to say if the clock mechanism is running too slow — there will be coincidence, at the AND-gate transistor 94 between the existing-value signal and the quartz timing pulse. As described above, this coincidence causes a storage capacitor 110 to be charged, in pulsed manner, to a positive voltage. In this way a transistor 112 is opened, together with transistors 114 and 116, located downstream of transistor 112, of an associated amplification channel. The corrector current of the power transistor 116 flows through a second acceleration coil 118, whose magnetic field causes the oscillation of the oscillating system to be accelerated.

As in the case of circuit layout of FIG. 3, the provision of transistors 120 and 122 enables a highly stable d.c. voltage of for example 1.5 V to be built up for the quartz timing generator and for the frequency divider.

In the synchronization of very sensitive mechanical oscillating systems, as for example pendulum clocks, a damping of the oscillation can occur in the course of synchronization carried out by acceleration coils. This is because the magnet, oscillating with the pendulum, induces alternating currents in the acceleration coils. In order to prevent the occurrence of such induction currents and the damping, associated with them, of the oscillating system, it is necessary to drive the accelerating coils with current sources having a high dynamic internal resistance. This is achieved, in the case of the circuit arrangement shown in FIG. 3, by providing the two power transistors 106 and 116 with high emitter resistances 124, 126 and also with diodes 128, 130 which limit the base voltage, as a result of which the collector current is limited and the collector-emitter d.c. voltage is prevented from dropping below the value of the saturation voltage.

Conveniently, the two acceleration coils 108 and 118 are so formed that a coil is double-wound, on a common core, to both sides of the permanent magnet attached to the mechanical oscillating system. The two windings of the two coils are cross-wound, so that one of the two windings belongs to the acceleration coil 108 and the other to the acceleration coil 118. This arrangement and winding of the acceleration coil has the advantage that, by reason of the symmetrical assembly of the acceleration coils 108, 118 which have an accelerating and decelerating effect, adjustment of the two coils in relation to the permanent magnets attached to the oscillating system is appreciably simplified, and the two acceleration coils always have exactly the same resistance.

FIG. 4 illustrates a modification of the circuit layout of FIG. 3. FIG. 4 only shows those parts of the circuit assembly which differ from the assembly shown in FIG. 3.

In the circuit layout shown in FIG. 4, the output pulses of the two AND-gates 92, 94 of the phase comparison stage also charge storage capacitors 100, 110. However, in contradistinction to the circuit layout of FIG. 3, field-effect transistors 132, 134 are connected to the input of the two amplifier channels 102, 104, 106 and 112, 114, 116.

An output signal, generated in the AND-gates 92, 94 of the phase comparison stage, charges the storage capacitors 100, 110 in pulsed manner. In consequence of the very high input resistance of the field-effect transistors 132, 134, the charging voltage of the storage capacitors 100, 110 remains practically constant, so that also the direct current, controlled by way of the amplifications channels 102, 104, 106 and 112, 114, 116, through the acceleration coils 108 and 118 — and, hence, the magnitude of the acceleration or of the deceleration of the mechanical oscillating system — remain constant.

After about one oscillation cycle of the mechanical oscillating system, the charging voltage of the storage capacitors 100, 110 is quenched, a quenching transistor 136, 138, which shunts the storage capacitors, being rendered conductive by a quenching signal. After the charging voltage has been thus quenched, the storage capacitors 100, 110 are recharged, in pulsed manner, on the occasion of the next oscillation of the oscillating system by reason of the new phase comparison in the phase comparison stage.

The control, with respect to time, of this process, may for example take place by means of three series-connected monostable multivibrators (not shown). The first multivibrator is controlled by the existing-value signal taken from the mechanical oscillating system and, through a suitable choice of its time constants, causes the phase comparison in the AND-gates 92 and 94 to coincide, in time, with the zero crossover of the mechanical oscillating system.

The first monostable multivibrator triggers the second monostable multivibrator which, in turn, triggers the third monostable multivibrator. The blocking pulses which render the blocking transistors 136, 138 conductive, are taken from the output of the second multivibrator. Finally, the AND-gates 92, 94 are controlled by the output of the third multivibrator.

The circuit arrangement of FIG. 4 ensures that the direct current in the acceleration coils remains practically constant for the duration of an oscillation cycle. The timewise control ensures that no signal delays can occur, so that control oscillations are reliably prevented. Also, the technique of effecting control by means of monostable multivibrators causes the changeover in charging condition of the storage capacitors 100, 110 to take place in the region of zero crossover of the mechanical oscillating system, that is to say outside the area in which the acceleration coils 108, 118 act on the oscillating system, as these acceleration coils lie at the reversal points of the oscillating movement.

This affords the advantage that any possible residual magnetic fields in the acceleration coils are compensated, in the zero crossover of the oscillating system, in the force which they exert on a permanent magnet oscillating with the magnetic system. Therefore, changeover in the charging condition of the storage capacitors 100, 110 during zero crossover of the oscillating system cannot adversely affect the sequence of oscillating motion.

FIGS. 5 to 18 illustrate different embodiments whereby firstly, the existing-value signal can be taken from the mechanical oscillating system and, secondly, how the member, which acts on the frequency of the mechanical oscillating system, can be constructed, this said member being controlled by the circuit layouts of FIGS. 1 to 4.

FIG. 5 illustrates an indirect synchronization of a pendulum clock mechanism, with proportional position control. A bar-shaped permanent magnet 142 is arranged on the pendulum rod 140, transversely of the axis of the latter, and shares the oscillating motion of the clock pendulum. On each side of this bar magnet 142 is a respective horseshoe magnet 144, each magnet lying in the region of the reversal point of the oscillation of the magnet 142. These horseshoe magnets 144 are stationarily mounted, although they can be pivoted, in their own plane, in a circular path of motion, symmetrically and synchronously of one another, this pivoting motion being driven by a toothed wheel gear train 146. According to a particular dimensioning given to the magnetic system and to the pendulum, the angle or rotation of the horseshoe magnets 144 amounts to about 60° to 90°.

The poles of the horseshoe magnet 144 are oppositely located so that, when the horseshoe magnets 144 pivot in one direction, i.e., downwardly as viewed in FIG. 5, both of these magnets approach the bar magnet 142 by their unlike poles. When the horseshoe magnets 144 pivot in the opposite direction, i.e. upwardly as viewed in FIG. 6, the drive poles of the horseshoe magnets 144 approach the bar magnet 142. Hence, symmetrical rotation of the two horseshoe magnets leads, according to the particular direction of rotation, to the bar magnet 142 being increasingly repelled at the reversal points of its oscillating motion — and, hence, to an acceleration of this oscillating motion — or to the bar magnet 142 being increasingly attracted at the reversal points of its oscillating motion and, hence, to a deceleration of this oscillating motion.

The horseshoe magnets 144 are caused to pivot by a control motor 62, arranged on the clock mechanism, this motor 62 acting through the intermediary of the toothed wheel gear train 146. The motor 62 may, for example, be controlled by the circuit layout shown in FIG. 2. This circuit assembly is schematically designated as 148 in FIG. 5. For the electrical supply of the circuit assembly 148 there may be provided an upstream-arranged electrical energy storage means 150, for example an accumulator, which is floatingly charged and is fed by a charging device 152 connected to the mains supply network.

The existing-value signal, which indicates the actual oscillation frequency of the pendulum 140, is obtained by the provision of a further bar magnet 154 on the pendulum rod 140, which moves a short distance beyond an asymmetrically stationarily arranged, magnetically biased field plate differential sensor 156.

It is also possible to use the bar magnet 142 for generating the existing-value signal in the field plate sensor 156, in which case the permanent magnet 154 may be dispensed with.

In the assembly shown in FIG. 5 it is merely necessary to accommodate the control drive, the horseshoe magnets, and the field plate sensor on the clock mechanism. The synchronization assembly 148, and also its current supply means 150, 162 may be accommodated at any other desired place, and may be connected to the components in the vicinity of the clock mechanism by screened leads 158.

The synchronization assembly illustrated in FIG. 5 does not cause any damping of the mechanical oscillating system, such as would impair the efficiency of the pendulum and finally bring the latter to a stop. Indeed, the amplitude of oscillation of the pendulum is further increased during the synchronising work, and remains unaltered in the prescribed condition, when existing-value frequency and prescribed-value frequency coincide. If circuit components 148 or the current supply means 150, 152 should be inoperative, the existing prescribed condition is maintained, so long as the actually-existing frequency value of the pendulum is not altered by external effects.

FIG. 6 depicts a further synchronization assembly, with proportional position control, for a pendulum clock mechanism, in which the member which affects the frequency of the oscillating system is constituted by accelerating coils. Again, a bar magnet 142 is arranged on pendulum 140. Acceleration coils 108 and 118 are stationarily arranged in the region of the points of reversal of the oscillatory movement of the bar magnet 142, and are controlled by a circuit as shown in FIGS. 3 or 4. The existing-value signal is taken from one of the acceleration coils, as shown in FIG. 3.

The embodiment of FIG. 6 is also particularly well suited for installing the synchronization device on an already-existing clock mechanism.

The whole of the circuit components 148, and the current supply means 150, 152, can be positioned separately from the clock mechanism to be synchronized and can be connected, by screened leads 158, to the acceleration coils 108, 118 arranged on the clock mechanism. The main advantage of the synchronizing assembly shown in FIG. 6 is that no movable parts are needed, so that the assembly is in a large measure maintenance-free and proof against disturbance in operation.

FIGS. 7 and 8 illustrate an embodiment of a system for the indirect synchronization of a pendulum mechanism with two-point control.

The pendulum 140, indicated in chain-dotted line, is, together with its armature 160, (which engages in a balance wheel 162), pivotably mounted by the armature shaft 164. Connected to the armature shaft 164 is a freely upwardly-projecting elongate member 166. At its upper end this freely-projecting member 166 carries a U-shaped short-circuit member 168, which itself carries a pair of permanent magnets 170. The poles of the permanent magnets 170 are arranged in NS—NS relation, so that there is a magnet flux present in the air gap between the magnets 170. In this air gap is an induction coil 172 in which, during pendulum oscillation, the existing-value signal is induced by the permanent magnets 170.

In the vicinity of the fulcrum of the elongate member 166 a leaf spring or wire spring 174 is attached to the armature shaft 164 and to the pendulum 140. Accordingly, this leaf spring 174 oscillates synchronously with the pendulum 140.

There is further provided a control magnet 176 which may for example consist of an E-shaped core onto which a coil body is double-wound. The armature 178 of the control magnet 176 is suspended by two arms 180 in a parallelogram-like linkage, and carries two small permanent magnets 182, which define the two stable end positions of armature 178. Attached to one arm 180 of the armature suspension linkage is a lever 184, which carries a fork 186 at its front end.

In one of the end positions of the armature 178, i.e. the end position shown in FIG. 7, the lever 184 is raised, so that fork 186 does not engage the free end of the leaf spring 174.

In the opposite (not shown) end position of armature 178, lever 184 is downwardly pivoted, so that the fork 186 can move over the free end of the leaf spring 174 and secure the latter. Owing to the leaf spring 174 being thus secured, it exerts an additional repelling torque, which increases the oscillation frequency of the pendulum.

The coils 30, 30' of the control magnet 176 may, for example, be exercised by the circuit assembly shown in FIG. 1.

As the frequency of the mechanical oscillating system can only be increased due to the free end of the leaf spring 174 being gripped, it is necessary — for exercising control when the clock mechanism is "running fast" and "running slow" — that the clock should run slow when the leaf spring is freely oscillating. Such "slow running" can be automatically caused, when the synchronization apparatus is installed on an existing clock mechanism, by arranging for the oscillation of the pendulum to be slowed up — when the clock has previously been running accurately — by the counterweight of the elongate member 166. It is a simple matter to thus install a synchronizing apparatus of the kind shown in FIG. 7 on an independently existing clock mechanism, as the elongate member 166 can, together with the leaf spring 174, be additionally placed on the armature shaft 164, as is clear from FIG. 8.

In order to reduce noise and wear, a thin U-shaped plate 188 of suitable properties may be placed over the upper end of the leaf spring 174. Further, the abutment 190 for the armature of electromagnet 176 may be lined on both sides with noise-damping material.

The "slow running" of the clock mechanism, prearranged in the case of the synchronization apparatus shown in FIG. 7, can, in the case of large clock mechanisms, easily amount to up to 30 minutes per day. If the acceleration obtained by gripping the leaf spring 174 amounts to 1 hour per day, then a control range ± 30 minutes per day is available. However, the prearranged "slow running" should be kept as small as possible, so that the control magnet 176 only has to be actuated infrequently so that the least possible demands are placed on the battery serving as current source.

FIG. 9 illustrates a modification of the synchronization apparatus of FIGS. 7 and 8.

In this embodiment a cantilever member 166 is fixed against rotation with the armature shaft 164 of the pendulum and carries, at its upper end, a capacitor electrode 192, for example a metal facing. Stationarily arranged opposite this capacitor electrode 192 is a second capacitor electrode 194. Through the oscillating motion of the pendulum 140 and, hence, of the cantilever member 166, the spacing between the capacitor electrodes 192 and 194 is altered, thereby altering the capacitance between the electrodes. This capacitance alteration can be tapped for an existing-value signal.

Further, a leaf spring 174 is fixed against the armature shaft 164. The free end of the leaf spring 174 is surrounded by a gripper 196. Gripper 196 consists of two arms which are swivellably mounted at one of their ends and are provided, also at this end, with teeth 198. Two arms of the gripper mutually engage by way of these sets of teeth, so that the opening- and closing-movements of the gripper 196 take place symmetrically.

A control motor 62 engages, by way of a worm gear 200 arranged on its shaft, in the teeth 198 of one of the gripper arms.

If the gripper is completely opened by the control motor 62, the oscillatory movement of the leaf spring 174 remains unaffected, and the pendulum swings without alteration. In the course of gradual closure of gripper 196, initially the movement of the leaf spring 174 is only restricted in the region of its maximum deflection. The further the gripper is closed, the greater the extent to which the movement of the leaf spring is delimited, as is also the acceleration of the pendulum oscillation. When gripper 196 is completely closed, the free end of the leaf spring is tightly gripped, a similar effect being achieved through fork 186 in the embodiment of FIG. 7.

The control motor 62 is itself controlled by a circuit layout shown in FIG. 2, so that a proportional position control of the frequency of pendulum oscillation is accomplished.

Gripper 196 can also be actuated by a control magnet 176, engaging in an arm of the gripper, the magnet either opening or completely closing the gripper 196 according to the instantaneous position of armature 178. A two-step control can be exercised by this equipment, the control magnet being regulated by a circuit layout as shown in FIG. 1.

FIG. 10 shows a further modification of the synchronizing apparatus of FIGS. 7 and 8. In this embodiment there is used, for affecting the swinging frequency of the pendulum, a control motor 62 which replaces the electromagnet 176. This motor 62 shifts — through the intermediary of a worm gear 200 arranged on its shaft — a restoring member 202 along leaf spring 174. This restoring member 202 secures the leaf spring 174 by means of a fork 204.

Through sliding the restoring member 202, leaf spring 174 is held, by fork 204, at different distances from its fixed end. In this way the restoring torque, exercised on the oscillating system, can be altered. The control motor 62 may, for example, be itself controlled by the circuit components shown in FIG. 2.

FIGS. 12 and 13 show a further embodiment of the member, acting on the oscillating frequency, for synchronizing a pendulum clock mechanism. In this embodiment a transverse arm 206 is mounted on the armature shaft 164 of the pendulum (not shown), and projects to both sides of the pendulum.

Permanent magnets 208 are positioned at both ends of transverse arm 206. A further transverse arm 210 is arranged above transverse arm 206, permanent magnets 212 being, again, arranged at its two ends. The poles of the magnets 208 and 212 are arranged such that they repel one another.

The transverse arm 210 can, with the assistance of a lever 214, be pivoted in a plane extending parallel to the transverse arm 206. The armature of a control magnet 176 is articulated to lever 24 by way of a rod 216, and may for example be controlled by circuit components such as are shown in FIG. 1.

In one of the positions of the control magnet 176, i.e. the position shown in FIG. 13, transverse arm 210 is so pivoted, by means of lever 214, that the permanent magnets 212 do not lie opposite permanent magnets 208 of transverse arm 206. In this position there is practically no repulsion exerted between permanent magnets 208 and 212 on each other. The pendulum therefore swings practically undisturbed. In the other position of control magnet 176, the armature 178 is displaced towards the left (as viewed in FIG. 13), and transverse arm 210 is so pivoted that it lies parallel to transverse arm 206, so that the permanent magnets 208 and 212 lie exactly opposite one another. In this position the magnets 208 and 212 repel one another to the maximum possible extent, and exert an opposing or restoring torque on the pendulum.

In this embodiment also it is only possible to accelerate the oscillating of the pendulum. In this embodiment also, it is necessary to prearrange "slow running" of the clock mechanism.

As control is exercised in a contact-free manner, there is no wear or noise.

Naturally, the control magnet 176 can be replaced by a control motor 62 in this embodiment. When such a control motor is employed, the transverse arm 210 can be continuously pivoted, so that a continuous adjustment of the "restoring" magnetic force, acting on the pendulum, is rendered possible. If control motor 62 is regulated by circuit components of the type shown in FIG. 2, then a proportional position control can be exercised.

FIGS. 14 and 15 show a modification of the embodiment of FIGS. 12 and 13. In the embodiment of FIGS. 14 and 15 permanent magnets 218 are stationarily positioned above the permanent magnets 208 of the transverse arm 206. There is additionally provided — so as to render variable the magnetic repelling force exerted by the permanent magnets 218 on permanent magnets 208 — a strip-like soft iron screen 220, which is pivotally arranged between the permanent magnets 208 and 218. The soft iron screen 220 can be pivoted, with the assistance of a control magnet 176 or of a control motor 62, in the manner adopted for the transverse arm 210 shown in FIGS. 12 and 13. In this way the magnetic repelling force acting on the pendulum can be adjusted for a two-step control or for a proportional position control.

FIGS. 16 and 18A show embodiments of the synchronizing apparatus which are suitable for balance wheel oscillating mechanisms.

In the case of these balance wheel oscillating systems, it is a particularly simple matter to obtain the existing-value signal by means of a capacitative tap, this being illustrated in FIG. 16. A plate-like capacitor electrode 222 lies opposite the outermost turn of the spiral coil 224 of the balance wheel, this outermost turn constituting the second electrode of the capacitor. As, in the course of oscillation of the balance wheel, the spiral spring 224 of the balance wheel executes a pulsating movement, the spacing between capacitor electrode 222 and the outermost turn of the spiral spring 224 of the balance wheel alters synchronously with the oscillation of the balance wheel. The alteration in capacitance brought about by this alteration in electrode spacing is tapped for obtaining an "existing value" signal.

There is provided, in the embodiment of FIG. 16 and with a view to acting on the oscillation frequency, a gripper 196 which is in essence similar to the gripper shown in FIG. 9. The gripper 196 surrounds the outer turn of the spiral spring 224 of the wheel at a spacing of about 90° from the secured end 226 of the sprial spring. If, as is the case in FIG. 16, gripper 196 is actuated by a control magnet 176, then, in one position of armature 178, it leaves the outermost turn of spiral spring 224 completely free so that the balance wheel can oscillate without stretching. In the other position of armature 178 the outermost turn of spiral spring is secured by the gripper, so that the oscillating frequency of the balance wheel is abruptly increased. For accomplishing this two-step control, control magnet 176 is itself regulated by the circuit components shown in FIG. 1.

Naturally, in the embodiment of FIG. 16, electromagnet 176 could be replaced by a control motor 62, with the result that the extent of opening of the gripper 196 could be continuously varied, resulting in a continuous alteration of the oscillation frequency of the balance wheel, because the movement of the outer turn of the spiral spring 224 of the balance wheel would be increasingly restricted in the region of its maximum excursion. In this way it is possible to exercise a proportional position control by acting on control motor 62 by means of the circuit layout shown in FIG. 2.

FIG. 17 shows an embodiment in which a back-motion member 228 is slidably arranged on the outer turn of the spiral spring 224 of the balance wheel, this member 228 securing the spiral spring. The back-motion member 228 is mounted on a lever 230, which is freely pivotable coaxially with of the balance wheel staff, and has a toothed segment 232' in its outer portion; engaging in this toothed segment 232' is a worm gear 200 which is mounted on the shaft of control motor 62. Through the action of control motor 62 back-motion member 228 is shifted, as is also the point at which the spiral spring 224 of the balance wheel is secured. In this way a proportional-position control over the oscillation frequency can be exercised, control motor 62 being itself regulated by the circuit layout shown in FIG. 2.

FIGS. 18A and 18B shows the balance wheel of a clock mechanism, usually designated as a "transistor clock", the drive being of a known type and therefore not being shown. For indirectly synchronization the clock mechanism, to the accuracy of a quartz standard and by the proportional position control method, a disc-like permanent magnet 234 is arranged on the balance wheel 232. When this permanent magnet 234 has swung through an amplitude of 180° in both directions, it lies, at both reversal points, in the region of an oval accelerating coil 236. The accelerating coil 236 is controlled by a circuit layout of the kind shown in FIGS. 3 and 4. There is therefore generated, in coil 236, a magnetic field which acts on the permanent magnet 234 at the two reversal points of its oscillating motion, this magnetic field acting either to accelerate or decelerate the balance wheel 232.

The permanent magnets 234 can either be constituted by a pair or magnets arranged on two balance wheel discs - one 236 being arranged between these magnets - or by a disc which, for example, is in the form of a samarium-cobalt magnet, as is shown in FIG. 18. The "existing value" signal can either be taken from the drive coil (not shown), or from the accelerating coil 236.

Naturally, the "existing value" signal does not have to be tapped in a particular way described in connection with each embodiment. In each embodiment it is possible to tap this signal capacitatively (as in the case of FIG. 9 and FIG. 16), inductively (as is the case in FIGS. 6, 7, 8, 10 and 11), or by a field plate sensor (as is the case in FIGS. 5 and 17).

If the voltage generated by a capacitative or inductive tap does not prove adequate for processing as an "existing-value" singal — and this may possibly be the case where very slowly-swinging pendulums are concerned — then a contact can also be actuated mechanically by the oscillating system, this contact being briefly actuated for supplying the battery voltage for generating the "existing-value" signal.

What I claim is:

1. A method of indirect synchronization of a mechanical oscillating system to the accuracy of a quartz standard, in particular the timing control of a clock, comprising the steps of: generating timing pulses from a quartz oscillator; deriving an existing-value signal from said oscillating system; comparing said existing-value signal with said timing pulses by a phase comparison and detecting frequency deviations of said existing-value signal; and adjusting the frequency of said mechanical oscillating system dependent on the deviations detected.

2. A method according to claim 1 including the step of switching abruptly the frequency of said mechanical oscillating system between an extreme value lying above a predetermined frequency and an extreme value lying below said predetermined frequency; and establishing the dwell period of said oscillating system in each of said extreme values by a separate phase comparison between the existing value signal and said timing pulses.

3. A method according to claim 2 including the step of selecting the frequency of said timing pulses to be equal to the mean value of the frequency of said mechanical oscillating system.

4. A method according to claim 2, including the step of using two separate phase comparisons, and deriving two timing pulse sequences from the quartz oscillation.

5. A method according to claim 1, wherein said frequency is adjusted continuously and proportionally to the deviation from a predetermined frequency.

6. A method according to claim 1 wherein the frequency of the quartz oscillations is synchronized by comparison with signals of a time signal and normal frequency transmitter controlled by an atomic clock.

7. A method according to claim 1 including the step of applying a torque to said oscillating system, said torque being controlled dependent on a phase comparison between said existing-value output and a signal from said quartz oscillator.

8. Apparatus for indirect synchronization of a mechanical oscillating system to the accuracy of a quartz standard, in particular the timing control of a clock, comprising: a quartz timing generator; a phase comparison stage with inputs; a frequency divider connected between said timing generator and an input of said comparison stage for applying said timing pulses of said generator to said comparison stage; said mechanical oscillating system having an existing-value output connected to a second input of said comparison stage; means for adjusting the frequency of said oscillating system and connected to the output of said comparison stage, said adjusting means being continuously adjustable by the output of said phase comparison stage.

9. Apparatus according to claim 8 wherein said phase comparison stage comprises a differential amplifier with inputs connected to outputs of said frequency divider, said amplifier being controllable by said existing value output signal.

10. Apparatus according to claim 8 wherein said phase comparison stage has two AND gates, one of said gates having inputs connected to two outputs of said frequency divider for supplying timing pulse sequences alternating in time, the existing-value output signal being applied to another input of each of said gates.

11. Apparatus according to claim 9 including a storage capacitor connected to one output connection of said phase comparison stage; a reversing stage connected between said storage capacitor and another output of said phase comparison stage; a second differential amplifier for comparing the voltage of said storage capacitor with a voltage representing the position of said means adjusting the frequency of said oscillating system; and means for controlling said adjusting means by the output of said second differential amplifier.

12. Apparatus according to claim 11 including a control motor for displacing said means for adjusting said frequency; a feedback potentiometer coupled to said control motor; said feedback potentiometer having a tap terminal connected to one input of said second differential amplifier; power amplifying means; and transformers for driving the control motor in opposite directions of rotation, said second differential amplifier having outputs connected to said transformers through said power amplifiers.

13. Apparatus according to claim 9 including storage capacitors connected to the outputs of said phase comparison stage; an amplifier channel; a current source having high internal resistance and connected in series with accelerating coils acting electromagnetically on said oscillating system, said storage capacitors having voltage controlling said current source in their charged condition through said amplifier channel.

14. Apparatus according to claim 13 including field-effect transistors in said amplifier channels and following said storage capacitors; and oscillating blocking transistors shunting said storage capacitors and controllable by the existing-value output signal from said oscillating system.

15. Apparatus according to claim 14 including three series-connected monostable multivibrators, a first of said multivibrators being controlled by the existing-value output signal; a second one of said multivibrators having an output controlling said phase comparison stage, said second multivibrator being triggered by said first multivibrator, said first multivibrator having a time constant so that changeover in the condition of said storage capacitors occurs at zero crossover of said mechanical oscillating system.

16. Apparatus according to claim 12 wherein said oscillating system comprises a clock pendulum, said means adjusting said frequency comprising a bar magnet arranged transversely to said pendulum axis and two horseshoe magnets lying in proximity of reversal points of the path of motion of said bar magnet, said two horseshoe magnets being pivotable synchronously and symmetrically by said control motor through a gear train, so that at any given time like poles on the magnet simultaneously approach like poles on the bar magnet or unlike poles on the magnet simultaneously approach unlike poles on the bar magnet.

17. Apparatus according to claim 12 wherein said oscillating system comprises a clock pendulum; said means adjusting said frequency comprising a leaf spring attached at one end to said pendulum; a return motion member connected to a free end of said spring, said return motion member being continuously shiftable by said control motor.

18. Apparatus according to claim 12 wherein said oscillating system comprises a clock pendulum; said means for adjusting said frequency comprising a transverse arm attached to said pendulum and projecting on both sides of said pendulum; permanent magnets arranged on the ends of said transverse arm; an auxiliary transverse arm substantially similar in dimensions of said first-mentioned transverse arm and positioned opposite said first-mentioned transverse arm; auxiliary permanent magnets arranged at the ends of said auxiliary transverse arm; the poles of said auxiliary permanent magnets being arranged so as to repel the magnets of said first-mentioned transverse arm; said auxiliary transverse arm being pivotable relative to said first-mentioned transverse arm by said control magnet between two positions.

19. Apparatus according to claim 12 wherein said oscillating system comprises a clock pendulum; said means for adjusting said frequency comprising a transverse arm attached to said pendulum and projecting on both sides of said pendulum; permanent magnets arranged on the ends of said transverse arm; two auxiliary permanent magnets fixedly arranged opposite said first-mentioned magnets and repelling said first-mentioned magnets; a pivotable soft iron screen positioned between the mutually opposing permanent magnets; said soft iron screen being pivotable relative to said transverse arm between two positions.

20. Apparatus according to claim 12 wherein said oscillating system comprises a balancing wheel with a spiral spring; said means for adjusting said frequency comprising a gripper surrounding one of the outer turns of said spiral spring of said balancing wheel; said gripper having arms continuously movable between a closed position and an open position.

21. Apparatus according to claim 12 wherein said oscillating system comprises a balancing wheel with a spiral spring; said means for adjusting said frequency comprising a return-motion member mounted an outer turn of said spiral spring; said return-motion member being pivotable about said balancing wheel axis and having an outwardly directed toothed segment engaging a worm gear connected to said control motor.

22. Apparatus according to claim 13 wherein said oscillating system comprises a clock pendulum with a permanent magnet; two accelerating coils acting on said permanent magnet, one of said coils generating when energized a magnetic field for decelerating oscillations of said pendulum, the other coil generating a magnetic field for accelerating said oscillation.

23. Apparatus according to claim 13 wherein said oscillating system comprises a balancing wheel with a permanent magnet; and an acceleration coil arranged with respect to the permanent magnet so that at each point of reversal of oscillating motion said permanent magnet arrives into the sphere of influence of said acceleration coil.

24. Apparatus according to claim 23 including a stationary induction coil and a permanent magnet moved with said oscillating system for generating the existing value output signal.

25. Apparatus according to claim 24 wherein said induction coil comprises an accelerating coil acting on said oscillating system.

26. Apparatus according to claim 23 including a capacitor with stationary electrode and an electrode moved with said oscillating system for generating the existing-value output signal.

27. Apparatus according to claim 23 including a stationary field plate and a permanent magnet moved with said oscillating system for generating the existing value output signal.

28. Apparatus according to claim 23 including an electrical contact closed by said oscillating system when said oscillating system has been deflected a predetermined amount for generating the existing-value output signal.

29. Apparatus for indirect synchronization of a mechanical oscillating system to the accuracy of a quartz standard, in particular the timing control of a clock comprising: two phase comparison stages; a quartz oscillator with a frequency divider connected thereto; said phase comparison stages being connected downstream of said frequency divider; a mechanical-electrical transducer on said mechanical oscillating system and connected to said phase comparison stages; a bistable electromechanical transducer with two triggering inputs connected to the outputs of said phase comparison stages, said bistable electromechanical transducer adjusting the frequency of said mechanical oscillating system.

30. Apparatus according to claim 29 wherein said phase comparison stage comprises AND gates connected to the outputs of said frequency divider for supplying alternate pulse sequences.

31. Apparatus according to claim 29 wherein said bistable electromechanical transducer comprises a control magnet with oppositely-acting coils, an armature moved between two stable positions by said control magnet, means connected to said armature for influencing the frequency of said oscillating system, the outputs of said phase comparison stages being connected through separate control signal channels to respective ones of said control magnet coils.

32. Apparatus according to claim 29 including means for applying an additional torque to said oscillating system, said torque being dependent on a phase comparison between said existing value output signal and a signal from said quartz oscillator.

* * * * *